US011413505B2

(12) United States Patent
Lorhpipat et al.

(10) Patent No.: US 11,413,505 B2
(45) Date of Patent: Aug. 16, 2022

(54) TAKRAW BALLS

(71) Applicants: SATIAN INDUSTRIES CO., LTD, Nakhon Pathom (TH); Martin Hammler, London (GB)

(72) Inventors: Boonchai Lorhpipat, Nakhon Pathom (TH); Sarun Lorhpipat, Nakhon Pathom (TH); Jirasak Suwannaset, Nakhon Pathom (TH); Suttiphun Jumpon, Nakhon Pathom (TH)

(73) Assignee: Satian Industries Co., Ltd., Nakhon Pathom (TH)

( * ) Notice: Subject to any disclaimer, the term of this patent is extended or adjusted under 35 U.S.C. 154(b) by 236 days.

(21) Appl. No.: 16/638,737

(22) PCT Filed: Jun. 8, 2018

(86) PCT No.: PCT/GB2018/052241
§ 371 (c)(1),
(2) Date: Feb. 12, 2020

(87) PCT Pub. No.: WO2019/034842
PCT Pub. Date: Feb. 21, 2019

(65) Prior Publication Data

US 2021/0128986 A1 May 6, 2021

(30) Foreign Application Priority Data

Aug. 14, 2017 (GB) ..... 1713030

(51) Int. Cl.
*A63B 39/06* (2006.01)

(52) U.S. Cl.
CPC ..... *A63B 39/06* (2013.01); *A63B 2209/00* (2013.01); *A63B 2243/00* (2013.01)

(58) Field of Classification Search
CPC . A63B 39/06; A63B 2243/00; A63B 2209/00; A63B 45/00; A63B 2039/003; A63B 39/00
USPC ..... 2/312, 319
See application file for complete search history.

(56) References Cited

U.S. PATENT DOCUMENTS 3,963,157 A * 6/1976 Truax ..... A63B 47/001 224/663
4,813,674 A * 3/1989 Lorhpipat ..... A63B 39/00 446/107
4,957,231 A * 9/1990 Kalisher ..... A01K 97/06 224/240
5,224,959 A * 7/1993 Kasper ..... A63B 21/0084 446/26
5,566,937 A * 10/1996 Lorhpipat ..... A63B 39/00 473/612

(Continued)

FOREIGN PATENT DOCUMENTS

GB 2196861 A * 5/1988 ..... A63B 39/00
GB 2408215 A * 5/2005 ..... B29C 45/1676

(Continued)

*Primary Examiner* — Steven B Wong
(74) *Attorney, Agent, or Firm* — Christopher Pilling

(57) ABSTRACT

A strip subassembly (2) which may be used to form a takraw ball or a similar woven ball, includes a backbone strut (4) and one or more pads (6) attached to the backbone strut (4). In the woven ball, the pads (6) form an even surface which is comfortable for the player.

16 Claims, 11 Drawing Sheets

(56) References Cited

U.S. PATENT DOCUMENTS

| | | | | |
|---|---|---|---|---|
| 7,794,343 | B2 * | 9/2010 | Lorhpipat | B29C 70/74 473/612 |
| 9,155,941 | B2 * | 10/2015 | Lorhpipat | A63B 39/00 |
| 2004/0134136 | A1 * | 7/2004 | Shearing | B64B 1/06 52/81.2 |
| 2004/0172888 | A1 * | 9/2004 | Shearing | B64B 1/58 52/81.1 |
| 2016/0107045 | A1 * | 4/2016 | Lorhpipat | A63B 39/06 473/612 |

FOREIGN PATENT DOCUMENTS

| | | | | |
|---|---|---|---|---|
| GB | 2513862 | A | * | 12/2014 |
| GB | 1713030.3 | | | 10/2017 |
| TW | 107127282 | | | 6/2019 |
| WO | WO2006/051248 | A1 | | 5/2006 |

* cited by examiner

FIG. 5A
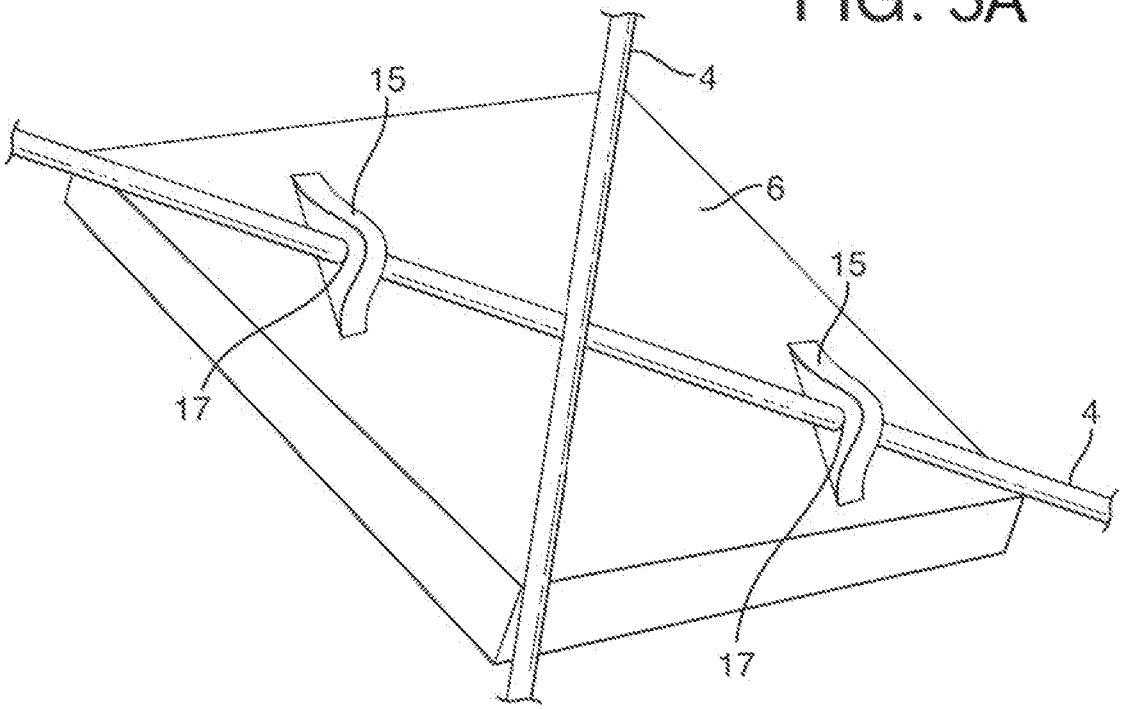
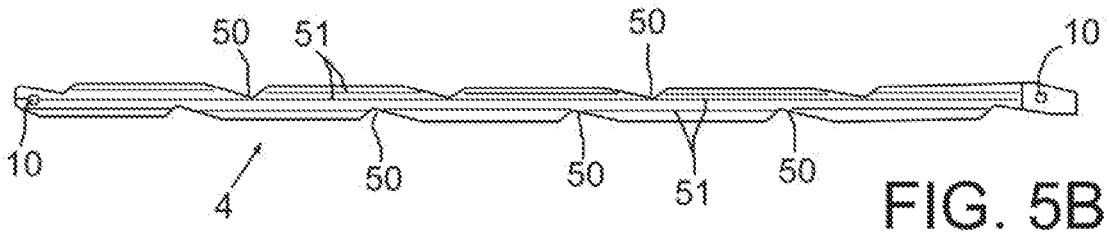
FIG. 5B
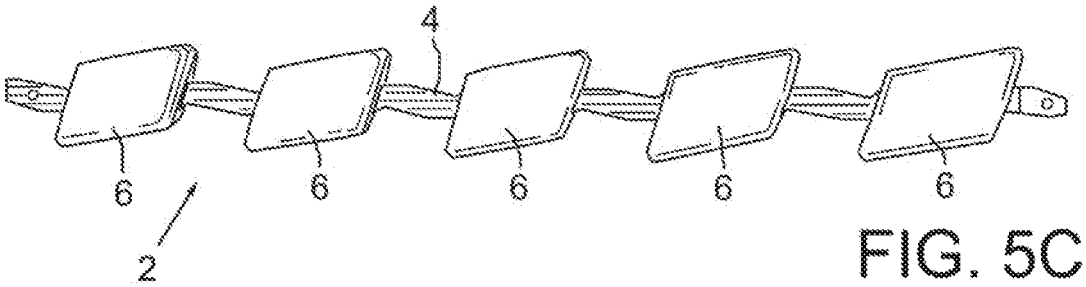
FIG. 5C

TAKRAW BALLS

BACKGROUND OF THE INVENTION

Field of the Invention

This invention relates to balls woven from strip-shaped subassemblies, as well as to these strip subassemblies themselves and the methods of weaving the strip subassemblies to form a ball. It includes synthetic takraw balls, their component parts and their methods of assembly, although is not limited to these exclusively.

Description of Related Art

Sepak Takraw is played by opposing teams passing a takraw ball across a chest-high net using feet, knees, head, shoulders etc., i.e. every part of the body except the player's hands and arms. The object of the game is to ground the ball in the opposing team's court; the rules of the game are similar to volleyball. Another form of takraw is hoop takraw, where only one team plays at a time and the players co-operate to pass the ball through a vertically orientated hoop some 5 meters above the ground.

Traditional takraw balls are manufactured by conventionally weaving split rattan into a spherical basket. Rattan stalk is split into long strands of 3 to 4 millimetres wide and 3 to 4 millimetres thick. Then these rattan strands are plaited spirally to form a circular band, like a spring coil of 8 to 12 turns. The number of turns will be determined from the width of the rattan strands used and the final tightness of the ball required. Newly woven rattan takraw balls are not round and have to be pressed by big tongs to force the rattan strands to squeeze into each other and form a substantially round ball. This is then treated with coconut oil to prolong storage life.

Synthetic takraw balls are manufactured by forming strips of plastic material into interwoven hoops. There are two main woven structures for existing synthetic takraw balls, those with completed hoops formed just from two side strips and those with completed hoops formed from two side strips and a centre strip. To assemble the takraw ball, six hoops of just one side strip are first interwoven and then the next set of six side strips are interwoven into the assembly to make a further six hoops next to the first six. In the case where centre strips are used, these are then interwoven to form a further set of six hoops between the opposing side strips. All of this interweaving is labour intensive, requires dexterity and is quite hard work. Particularly weaving in the last strips and joining their ends to form hoops requires strong fingers. The resulting ball is described in GB2196861.

It is an important handling characteristic of the takraw ball for it to be resilient but stiff. This is to obtain the maximum kinetic energy transfer when the ball is struck so that the ball's flight or trajectory is as far, fast or high as possible. A takraw ball's bounce characteristic is much closer to the essentially hard, low strain, kinetic energy conserving collision between billiard balls than the softer, higher strain, kinetic energy absorbing collision between a squash ball and racket. The woven structure of a takraw ball modifies its bounce characteristic. There is a small amount of relative movement between the strips that contributes to the essential "feel" of the ball.

A regulation Sepak takraw ball is defined as "spherical of one woven layer having 12 holes, 20 intersections. It shall be made of synthetic fibre or natural rattan. If it is made of rattan, it shall consist of 9-11 strains. For a competition ball, the circumference shall not be less than 0.42 m and not more than 0.44 m (0.43 m to 0.45 m for women). The weight before play shall not be less than 170 gm. and not more than 180 gm. (150 gm. to 160 gm. for women)."

Document WO95/28206 describes a takraw ball woven from strips of composite material of which one part is of soft material and another part of springy material. As shown in and described with reference to FIGS. 12-15 of that document, the strips provide subassemblies in accordance with the pre-characterising portion of claim 1.

Document WO2006/051248 describes a takraw ball woven from strips of springy material having soft material pads moulded into recesses in a strip outer face.

Document GB2494478 describes a takraw ball woven from strips of plastics material with one side edge of undulating profile having troughs and peaks. The strip is shaped or otherwise constructed to be preferentially longitudinally flexible in peak regions, so that the strip naturally adopts a more circular shape when bent into a hoop.

Document GB2513862 describes a takraw ball woven from plastic side strips, and, optionally, plastic centre strips; both having through-going slots so that the outer surface of the woven ball is essentially composed of synthetic rattan-like slivers. The slivers provide reduction of pain for a player, improved bouncing properties, a measure of independent transverse sliver movement and improved sphericity.

A "playability" problem of both the conventional rattan takraw ball and the above-described synthetic takraw balls is that their stiffness makes them hard and playing takraw can be quite painful; especially for the novice. Clearly, this limits the popularity of the game as a participation sport.

A "durability" problem is that the hardness of the takraw ball can be dangerous. In conventional balls the rattan can unexpectedly break or splinter and cut the skin of a player. Similarly, the plastic takraw ball can break. Takraw can be played on almost any surface, not just the gymnasium floor of competition events or sand for beach takraw, and some surfaces, such as concrete, can rapidly abrade/wear the surface of both types of ball; it is this that can particularly lead to ball breakage.

Documents WO-A-95/28206 and WO-A-2006/051248 address the playability problem by providing soft or springy material outer surfaces. However these soft/springy surfaces affect the durability and handling characteristics of the takraw ball. Document GB-A-2196861 addresses the durability problem of conventional rattan balls by using plastic strips and WO-A-2006/051248 protects the soft material pads by moulding the pads into recesses in the outer face of the strip. None of these give much variability in playing characteristics to suit different user groups, i.e. novice/casual/amateur players vs. traditional/serious/professional players, children vs. adults, etc. There are also assembly difficulties as noted above.

BRIEF SUMMARY OF THE INVENTION

The present invention seeks to provide a synthetic takraw or similar ball having one or more of improved playability, durability, handling characteristics and ease of manufacture.

The present invention provides a strip subassembly for weaving to form a ball, as set out in claim 1. The invention correspondingly provides a ball, such as a takraw ball, woven from such strip subassemblies, as set out in claim 11. Further optional and inventive features are set out in the dependent claims.

In takraw balls of the prior art, the interwoven side and centre strips form both the structure and the surface of the ball. In contrast, when the strip subassemblies of the present invention are assembled to form a ball, the backbone struts form the internal structure of the ball and the pads form the surface of the ball. The backbone struts therefore need not be exposed at the surface of the ball.

In the prior art takraw balls, the ball surface together with the ball structure are woven by bending and pushing a free end of one strip up and down and in and out of other strips, crossing the other strips to form a spherical basket. Then the ends of each strip are joined to make interwoven hoops to form a takraw ball. With the present invention, the pads can be positioned and arranged on the backbone struts so that when the strip subassemblies are assembled to form the ball (with the backbone struts crossing one another and neighbouring pads on one backbone strut positioned next to, and on either side of, a pad on another, crossing backbone strut), the pads are arranged with their outer surfaces arranged to lie aligned on a sphere or regular polygon. In such an arrangement, the outer surfaces of the pads may be aligned with each other and the pads need not jut out one relative to another or cross over or overlap one another.

Because the prior art strips have springy stiffness, during the ball weaving process, the surface of a strip always has friction and rubs against other strips as the strip is bent and pushed/pulled to go under or over the other strips. The visible surfaces of the strips can therefore be scuffed, scratched or otherwise damaged, or subjected to stress whitening, if woven carelessly or inexpertly or in a dirty or gritty environment. But when using the subassemblies of the present invention to form a ball, the pads themselves are not pulled past other pads or other components in the interlocking assembly process and therefore the pad outer surfaces are not subjected to friction or abrasion during assembly of the ball. Furthermore, ball assembly is faster and easier than when using the prior art side and centre strips or traditional rattan strands.

It is the pads which make up the shaped (outer) playing surface of the ball formed from the subassemblies of the present invention. In previous takraw ball designs and structures, the ball's surface comprises crossing and adjacent side strips and centre strips, or crossing and adjacent rattan strands. When such a ball strikes a player's skin, each strip or strand has a different shape, deformed out of its generally circular, rest-state shape. Even absent such deformation, protruding edges of the woven structure can create pressure points which cause pain to a player. After the ball bounces back, the deformed circular strips try to go back to their original places, and the closing gaps between different deformed strips can nip the skin or hair of the player. With the woven structure of prior art takraw balls, it is unavoidable that one strip or strand overlies another in layers, creating relatively sharp edges or corners at the upper layer and creating spaces between layers, strips and strands, which open/close/nip as the ball deforms and recovers its original shape during play. A generally smooth spherical surface cannot be made, so the prior art takraw ball structures can cause pain to a player upon impact. The present invention is able to provide a homogeneous, single-layered, non-overlapping, uniformly and synchronously deformable outer surface, devoid of sharp edges, corners or pinch points in play.

Therefore balls constructed from the subassemblies of the present invention may have a surface which is more smooth, more round, and may be formed from soft, sensitive surface materials, e.g. low density material with air bubbles like resilient foam or sponge. The properties of the pads and hence the ball surface layer may be varied to suit different games and different types of players. The surface formed by the pads determines the feel and control of the ball while the backbone struts maintain the roundness and structural strength of the ball. Some properties such as resiliency and damping can be controlled or adjusted by selecting the material properties of either or both of the pads and the backbone struts. With the new method of construction and assembly the backbone struts can also be hidden once the ball assembly is complete. This allows the surface of the ball to be fully padded with softer shock absorbent material while the backbone struts can be formed from e.g. a much harder highly resilient material (including composites) to control bounciness and propulsion of the ball after impact. Utilizing suitable materials having different properties in the subassembly means balls can be made to travel fast for a thrilling game but they will land with softer shock upon impact with the body and limbs.

A greater understanding of the invention, and some of its optional features and advantages, may be had from the following description of illustrative and non-limiting embodiments, made with reference to the drawings.

BRIEF DESCRIPTION OF THE DRAWINGS

FIG. 5A is a bottom (inside surface) view of an alternative crossover arrangement of a strip subassembly to FIGS. 1 to 5, showing one pad attached to a backbone strut by means of attachment hoops through which the backbone strut runs, with a further backbone strut crossing over it;

FIG. 5B is a top (outside) plan view of an alternative form of backbone strut from those used in FIGS. 1A, 1B, 3, 4 and 5A;

FIG. 5C shows the backbone strut of FIG. 5B with pads attached, but before it is woven into a ball and secured to form a hoop;

DETAILED DESCRIPTION OF THE INVENTION

The present disclosure relates to a strip subassembly comprising a backbone strut and one or more pads threaded or otherwise formed onto the backbone strut, as well as a ball, such as a takraw ball, woven from such strip subassemblies and a method of weaving a ball from such strip subassemblies. The ball of the present invention is a development of the takraw balls described in documents GB2196861, WO95/28206, GB2494478 and GB2513862.

GB2513862 describes a takraw ball made up of synthetic rattan-mimicking side strips, which form the main structure of the ball, and narrower centre strips, which act as wedging parts to achieve the final, tightly woven ball. The present invention, on the other hand, is made up only of relatively narrow struts which act as the "backbones" of the structure and which have pads threaded or otherwise formed onto or attached to them.

Figure 1A:
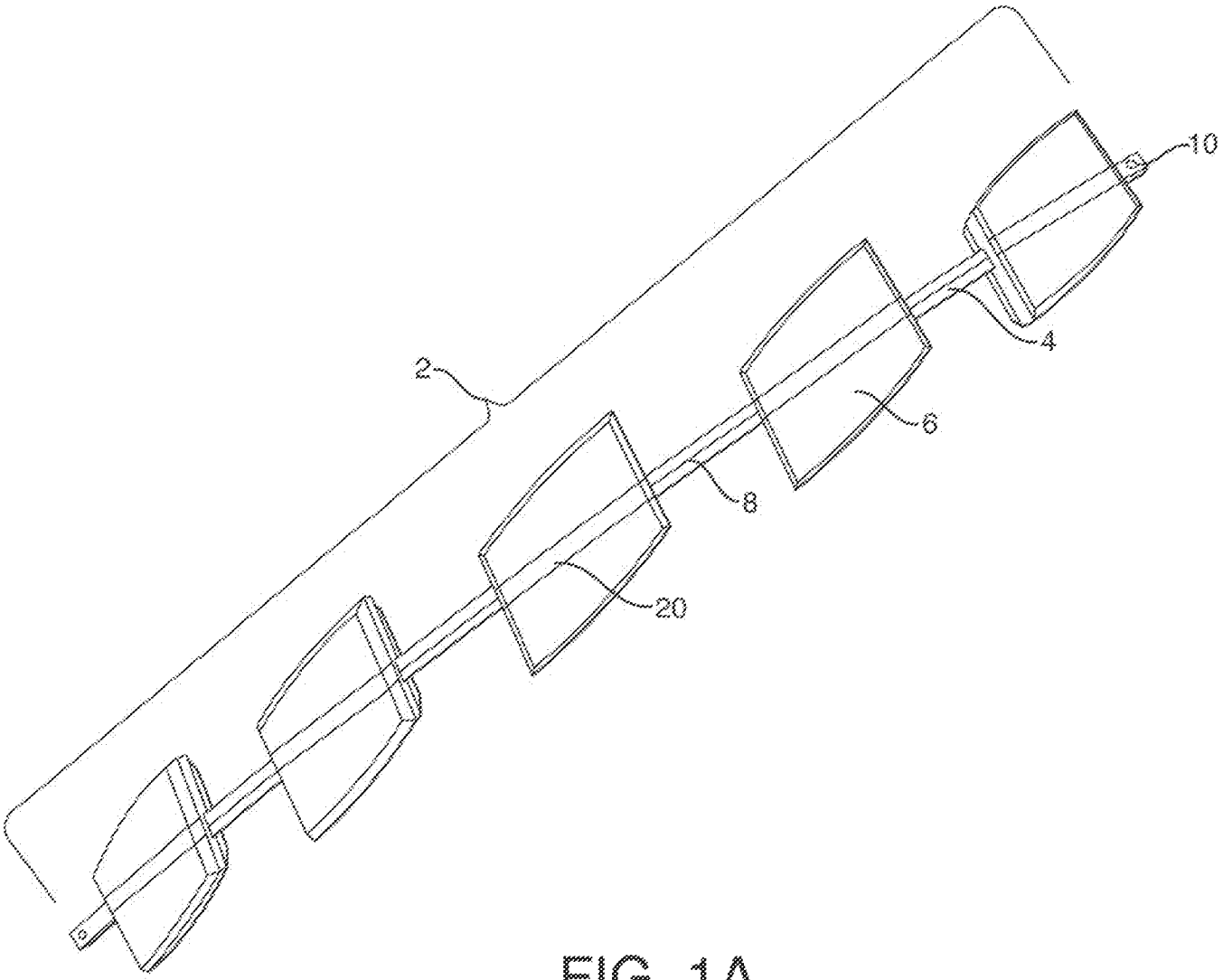
FIGS. 1A and 1B are respectively a top (outside surface) plan view and a bottom (inside surface) plan view of a strip subassembly of a backbone strut and five pads which may be used together with identical subassemblies to weave a takraw ball embodying the invention.
Figure 1B:
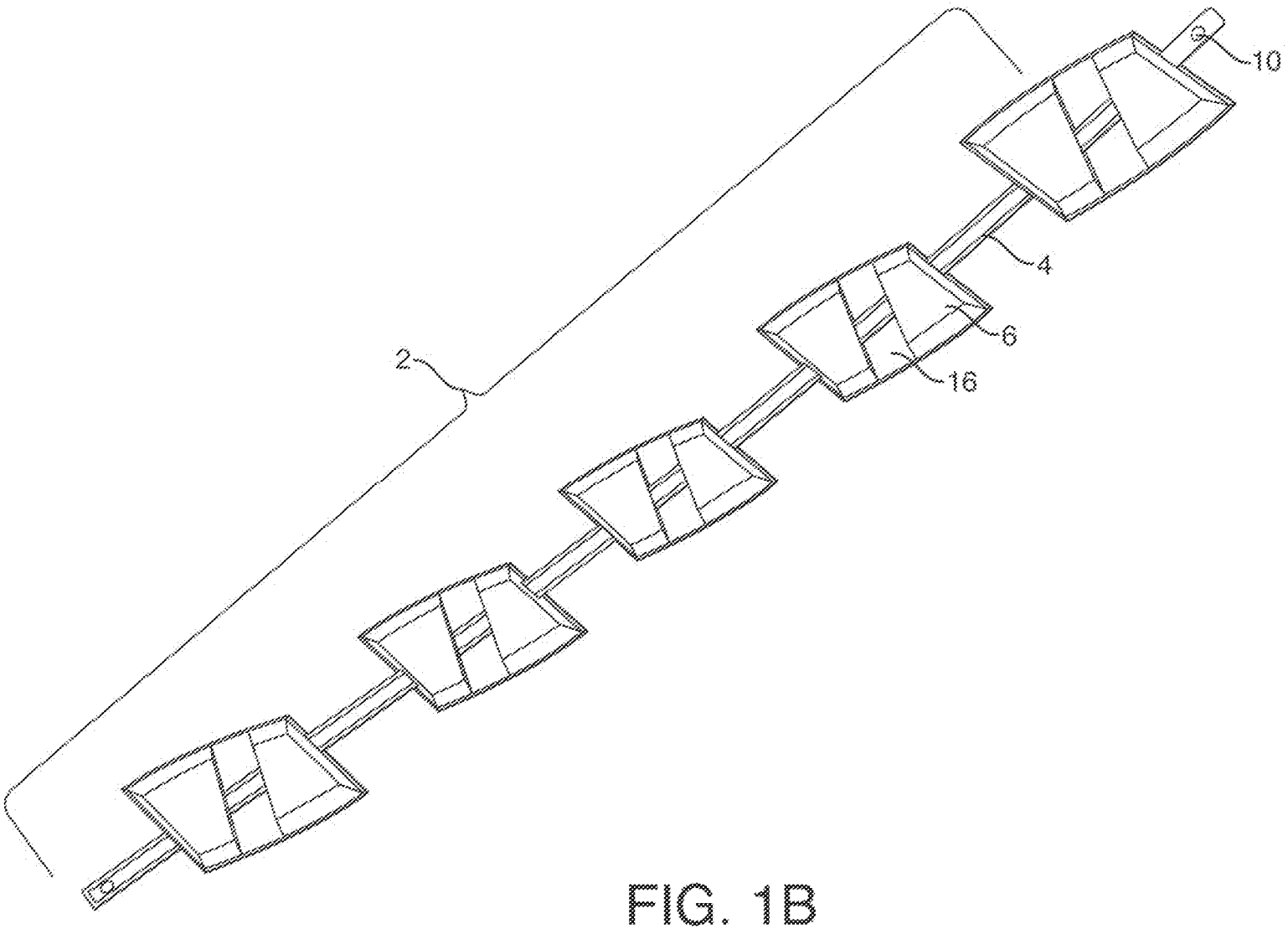

FIGS. 1A and 1B are plan views of the outside and inside surfaces respectively of a strip subassembly 2 of the present invention. The subassembly consists of a backbone strut 4 and five pads 6, which may be used together with identical subassemblies 2 to weave a ball, such as a takraw ball, of the invention. For the prototype ball shown in FIGS. 1 to 4, 5A and 6 to 10, for convenience the centre strips of GB2513862 have been used as the backbone struts 4. However this is not essential and backbone struts 4 of other transverse cross-sectional shapes and/or materials may be used as well or instead. An example of another backbone strut 4 is shown in FIGS. 5B and 5C, which are discussed in more detail below. Returning to FIGS. 1A and 1B, the upper face of a backbone strut 4 as shown has one or more longitudinal grooves 8 and the lower face has a large rectangular sectioned groove which lends an overall, generally U-shaped transverse cross-sectional profile to the backbone strut 4, but this need not be the case for the backbone struts 4 of the present invention. In the finished ball, the upper face of the backbone strut faces outwardly and the bottom face of the backbone strut faces inwardly.

Figure 4:
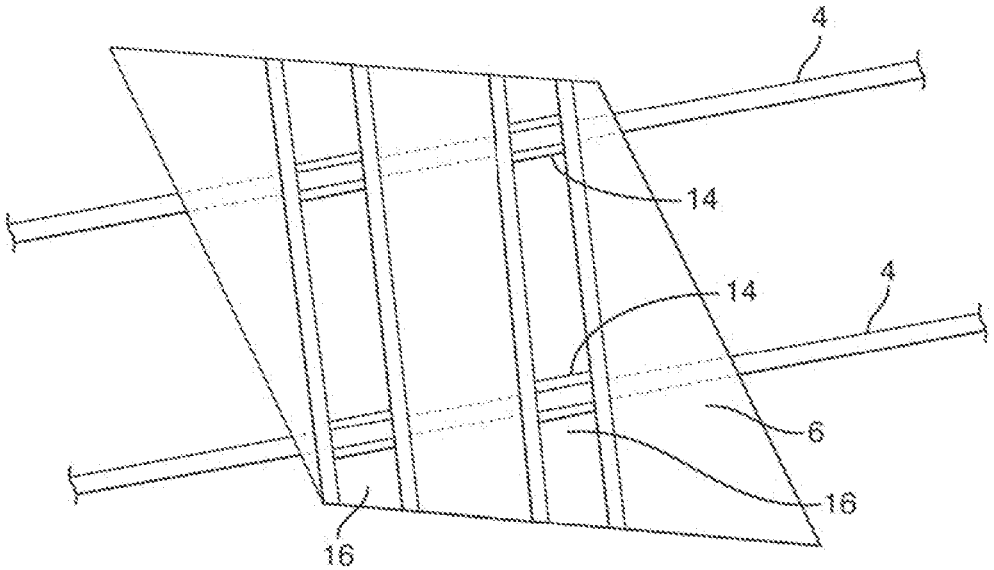
FIG. 4 is a bottom (inside surface) view of an alternative embodiment to FIG. 3, showing one pad attached to two backbone struts forming a section of a strip subassembly.

Each backbone strut 4 shown in FIGS. 1A and 1B is approximately 43.5 cm long and is moulded from a suitable plastic material (such as polypropylene, high density polyethylene, nylon, or plasticised PVC), to have straight side edges. It may be U-profiled in transverse cross-section as described above, or otherwise non-circular, to prevent the pads 6 from rotating about the strut longitudinal axis and to allow for better bending into the spherical shape of the ball. Another option to prevent the pads from rotating about the strut longitudinal axis is to thread the pads 6 onto more than one backbone strut 4 in parallel, as shown in FIG. 4 and discussed in more detail below. In general, the backbone struts may have any suitable cross-sectional profile to provide the desired weight, stiffness and resiliency characteristics in the finished ball. For example, the strut transverse cross-sectional profile may be round, half-round or the like, rectangular, X or cross-shaped, I-beam, or hollow (e.g. tubular or box-section). Through holes 10 are provided proximate each end of a backbone strut 4 suitable for receiving press-in plastic fasteners 12 or other suitable fasteners, such as pop rivet and washer assemblies, to hold the two ends together in a hoop. Where the strut 4 is made from a suitably plastically deformable material such as metal wire, the ends of the strut may simply be twisted together to secure them to form the hoops. The twisted ends can be tucked inside the hollow interior of the finished ball, or hidden within the pad 6 interiors. Any other suitable end fastening means can be used, e.g. an integrally moulded, snap-in spigot and socket connection. Additionally or alternatively, as shown in FIGS. 5B and 5C and discussed in more detail below, the backbone struts 4 may have grooves or other features providing texture to their surfaces, and/or may have a non-linear shape, for purposes discussed below.

Figure 2A:
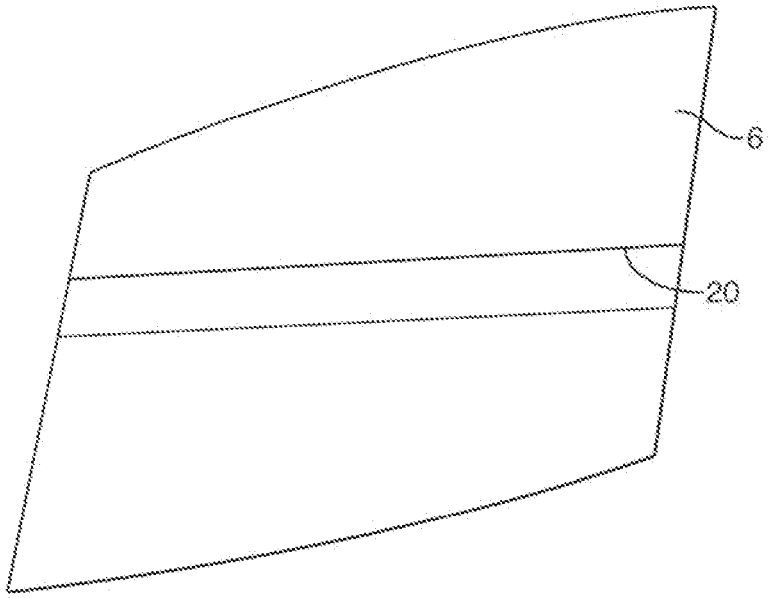
FIGS. 2A and 2B are respectively a top (outside surface) plan view and a bottom (inside surface) plan view of one pad of the strip subassembly of FIGS. 1A and 1B, without the backbone strut in place.
Figure 2B:
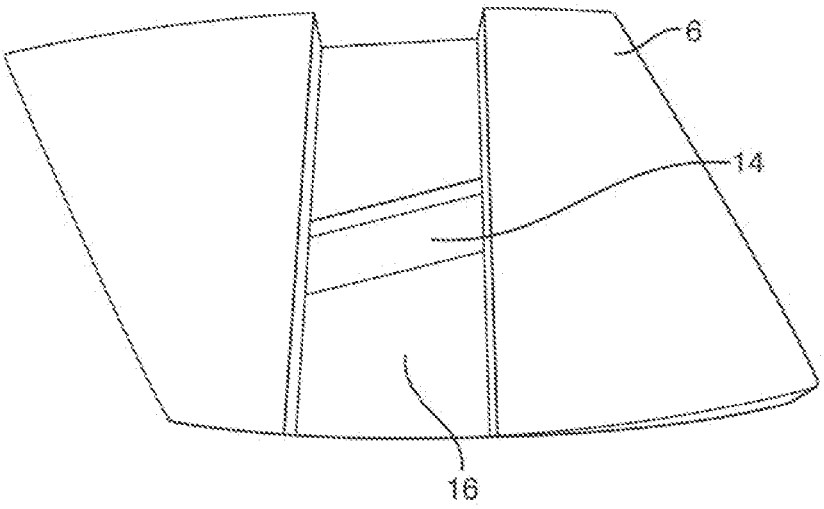

FIGS. 2A and 2B show the pad 6, from above and below respectively, of the strip subassembly of FIGS. 1A and 1B, without the backbone strut 4 in place. Each backbone strut 4 has five pads 6 threaded or otherwise formed (e.g. co- or insert-moulded) or fixed onto it, which may be polymer foam pads, such as of ethylene-vinyl acetate (EVA) foam, or any other suitable foamed plastic or elastomeric material. The properties of the foam can be adjusted, for example by a foaming agent, to give the correct hardness/softness or a range of hardnesses/softnesses depending on who will be using the ball, and the requirements of the game in winch the ball is being used. The pads therefore define cushioning pads comprising a unitary body of cushioning material.

Figure 3:
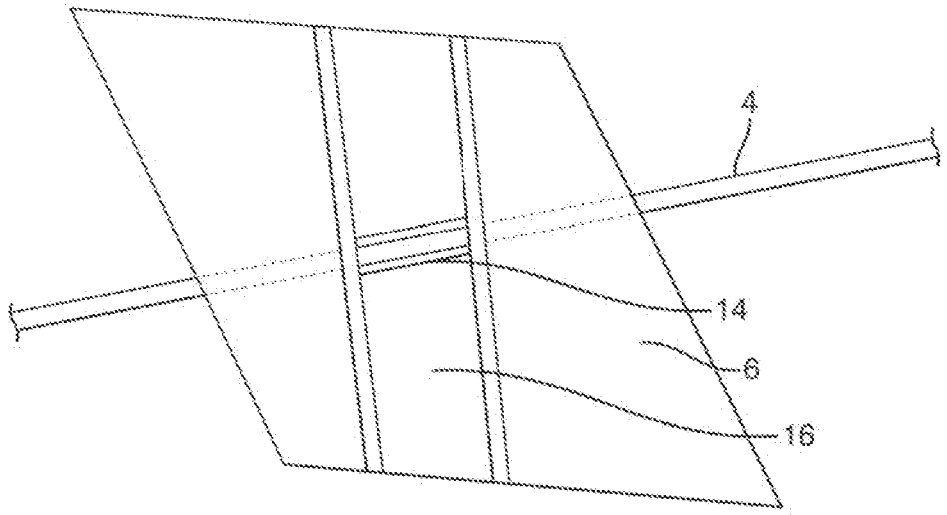
FIG. 3 is a bottom (inside surface) view of one pad attached to the backbone strut of the strip subassembly of the backbone strut and pads of FIGS. 1A and 1B.

The final pads 6 may have one or more holes or passages 14 running through them longitudinally, through which the backbone strut(s) 4 are threaded or otherwise run, and may have one or more channels 16 running across them transversely which intersect the longitudinal hole(s) or passages 14, allowing the backbone strut(s) 4 to overlap and directly contact each other. This occurs at a 60°/120° angle in the takraw ball shown in FIG. 10, but may occur at other angles in other embodiments. The channels 16 may be wider than the backbone struts, to make assembly of the ball easier. The additional width of the channels also allows movement of the backbone struts relative to and against each other at their crossover points, which makes the ball more flexible. Rubbing movement of the backbone struts against each other and against the adjacent pads provides frictional damping and sounds in play, which can be used for example to mimic properties of a rattan takraw ball. FIG. 3 shows the prototype arrangement of the backbone strut 4/channel 16/longitudinal hole 14 arrangement which allows the overlapping of strip subassemblies 2. The depth of the channel 16 and the depthwise positioning of the hole or passage 14 may be arranged so that, in the finished ball, the outer surfaces of all the pads 6 are homogeneously co-aligned, e.g. arranged along a spherical or regular polygonal surface. The pads need not overlap, avoiding or reducing any protruding edges or corners which could be painful when the ball hits a player, and/or having the potential to trap and pinch the player's skin or hair as different parts of the ball deform by different amounts and then recover during play.

FIG. 4 shows an embodiment otherwise similar to that of FIG. 3, but in which one pad 6 is attached to two backbone struts 4 of a strip subassembly 2, through correspondingly two longitudinal hole(s) or passages 14, which are intersected by two channels 16 for receiving the two backbone strips 4 of another such strip subassembly 2. In both FIGS. 3 and 4, the position of the backbone strut(s) 4 running through the pad is indicated by a dotted line continuing on from the solid line of the visible portion of the backbone strut(s) 4. The arrangement of backbone struts 4 contacting each other at their crossing points, made possible by the intersection of the pad channels 16 with the pad through holes or passages 14, allows the interwoven, hooped struts 4 to assume a substantially circular shape in the finished ball, with all of the pads aligned to form a regular shell, for example with their outer edges and outer surfaces arranged to lie aligned on a sphere or regular polygon, providing the same lack of protruding edges and pinch points, and hence the same advantages over the prior art, as described above.

When formed separately from the struts 4, the pads 6 may be moulded in one piece or may be of laminated construction to provide the required hole or passage 14 and channel 16. Several pads 6 or their component parts may be multi-moulded together in a single operation to reduce the flash, and then cut along linking web portions to form the individual pads or pad pieces. The pieces are then laminated together if required, e.g. using a suitable adhesive, to form the individual pads 6. The pads 6 (five such pads for a regulation takraw ball) may be glued to the backbone strut or struts 4 onto which they are threaded to form a strip subassembly 2. Alternatively, the pads 6 may be co- or insert-moulded on the strut(s) 4, to form the strip subassemblies 2, as described above. In yet another embodiment, as shown in FIG. 5A, the pads 6 may be attached to the backbone strut 4 by means of one or more attachment lugs 15 or other structures situated on or projecting from the rear or inner face of each pad 4, which have a hole or passage 17 through which the backbone strut 4 runs. Where each pad is attached to more than one backbone strut (similar to the arrangement shown in FIG. 4), the number and positioning of the lugs 15 or other structures is modified accordingly. The lugs 15 and their holes or passages 17 may be configured and positioned so that when the resulting subassemblies are assembled into a ball, the outer surfaces and edges of the pads are again arranged to lie aligned on a sphere or regular polygon so as to provide the advantages of improved player comfort as discussed above.

FIG. 5B shows an alternative form of backbone strut 4, whilst FIG. 5C shows this form of backbone strut 4 with pads 6 attached to form a strip subassembly 2. In this embodiment, the backbone strut 4 comprises a generally flat strip which has asymmetrically staggered notches 50 cut, moulded or otherwise formed in the sides so that its overall shape is non-linear. The non-linear shape may help to hold the pads 6 in position on the backbone strut 4 and prevent them from slipping longitudinally. Broader, un-notched parts of the backbone strut 4 are received inside the pads 6 help to support them, reducing impact stresses and also prevent the pads from twisting on the backbone strut 4. Adjacent pairs of the notches 50 in opposite sides of the backbone strut 4 make a narrower, sloping portion which can fit into the groove 16 on the bottom of a pad 6 attached to a crossing backbone strut 4, this groove being at substantially 90 degrees to the long edges of the pad 6 in which it formed (or at any other desired angle as dictated by the notch shapes and relative positions). The non-linear shape of the strut 4 may also cause the pads 6 to tilt slightly relative to one another when the strip subassembly 2 is bent into a hoop, helping the outer surfaces of the pads 6 to align in a more spherical shape. The non-linear shape (where present) and/or broader and narrower sections (where present) of the backbone strut 4 may take other forms (e.g. zig-zag or sinuous) and may be achieved in other ways than by use of notches such as 50. FIGS. 5B and 5C further show how a backbone strut 4 may be provided with one or more grooves 51 or other features providing texture or roughening on their surfaces (upper or lower or both), which may help to hold the pads 6 in position on the backbone strut 4 and may help to prevent them from rotating around the longitudinal axis of the backbone strut 4, due to the extra friction caused thereby. The texture or roughening at the crossing points of the backbone struts in the finished ball can be used to vary or adjust the frictional damping and sounds produced as the struts rub against each other in play as described earlier.

A number (six for a regulation takraw ball) of strip subassemblies 2 are woven together to form a ball. During such weaving, the pads 6 are not dragged past one another or past other parts of other strip subassemblies, so there is no frictional damage to the pads and assembly is much easier than is the case for prior art takraw ball weaving methods. Nevertheless, the movement of the pads 6 and/or struts 4 against each other during play can still give a similar sound and feel to a traditional takraw ball made of rattan fibres. When desired, however, the pad material can be chosen to provide softer, less painful player contact in use.

Figure 6:
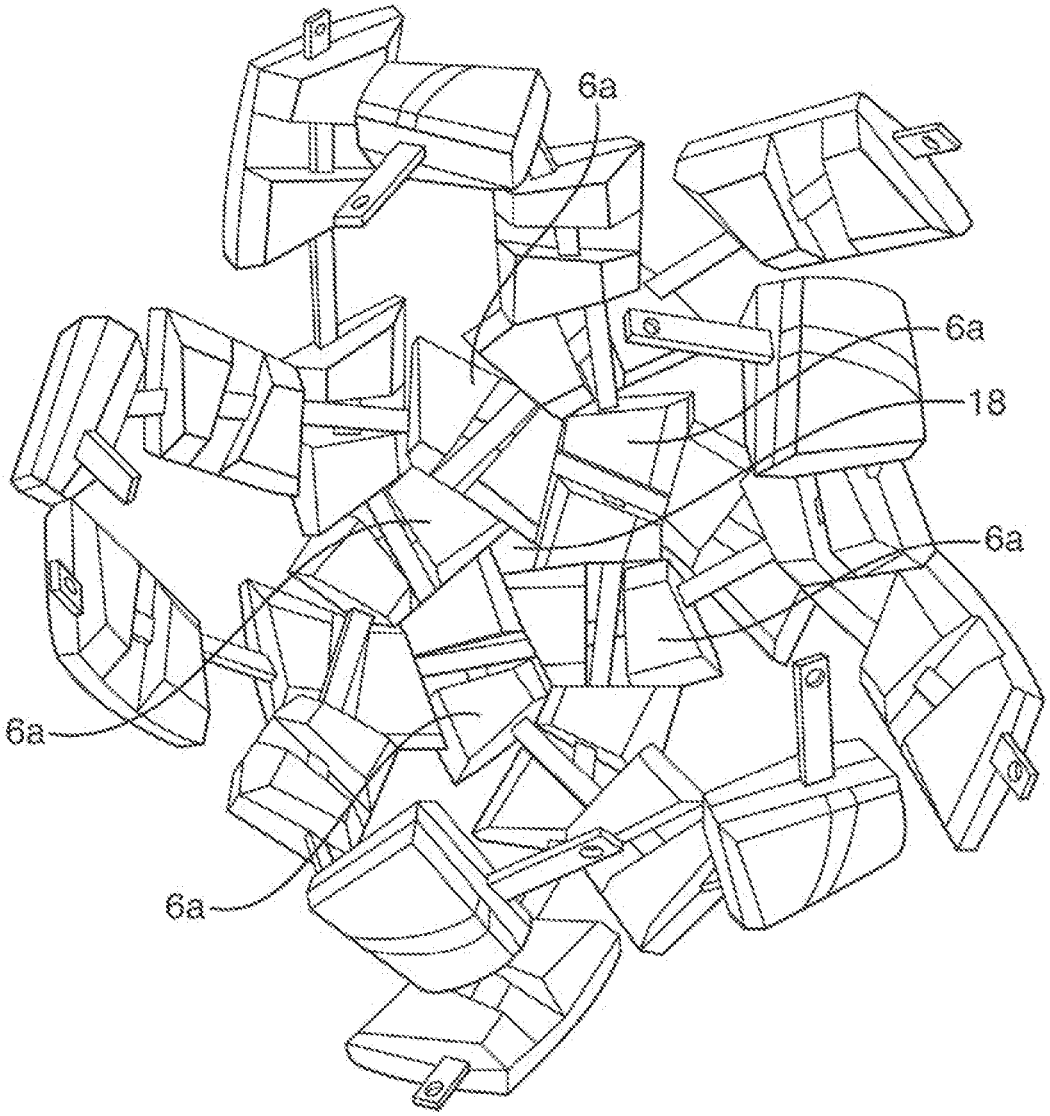
FIG. 6 shows a first stage, requiring five of the subassemblies of FIGS. 1A and 1B, in the weaving of six of the subassemblies to form a takraw ball.
Figure 7:
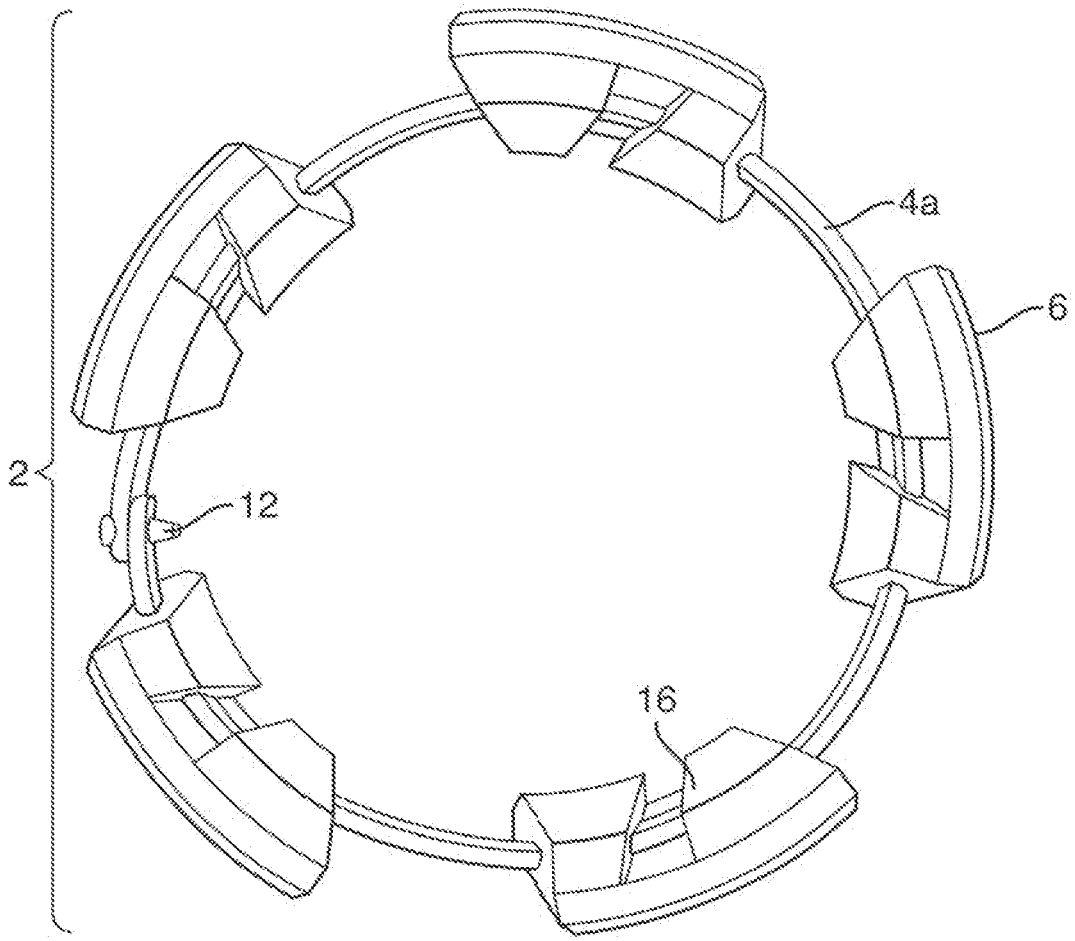
FIG. 7 shows the sixth subassembly of FIGS. 1A and 1B required in the weaving of six of the subassemblies to form a takraw ball, bent into a hoop and fastened by a press-in plastic fastener.
Figure 8:
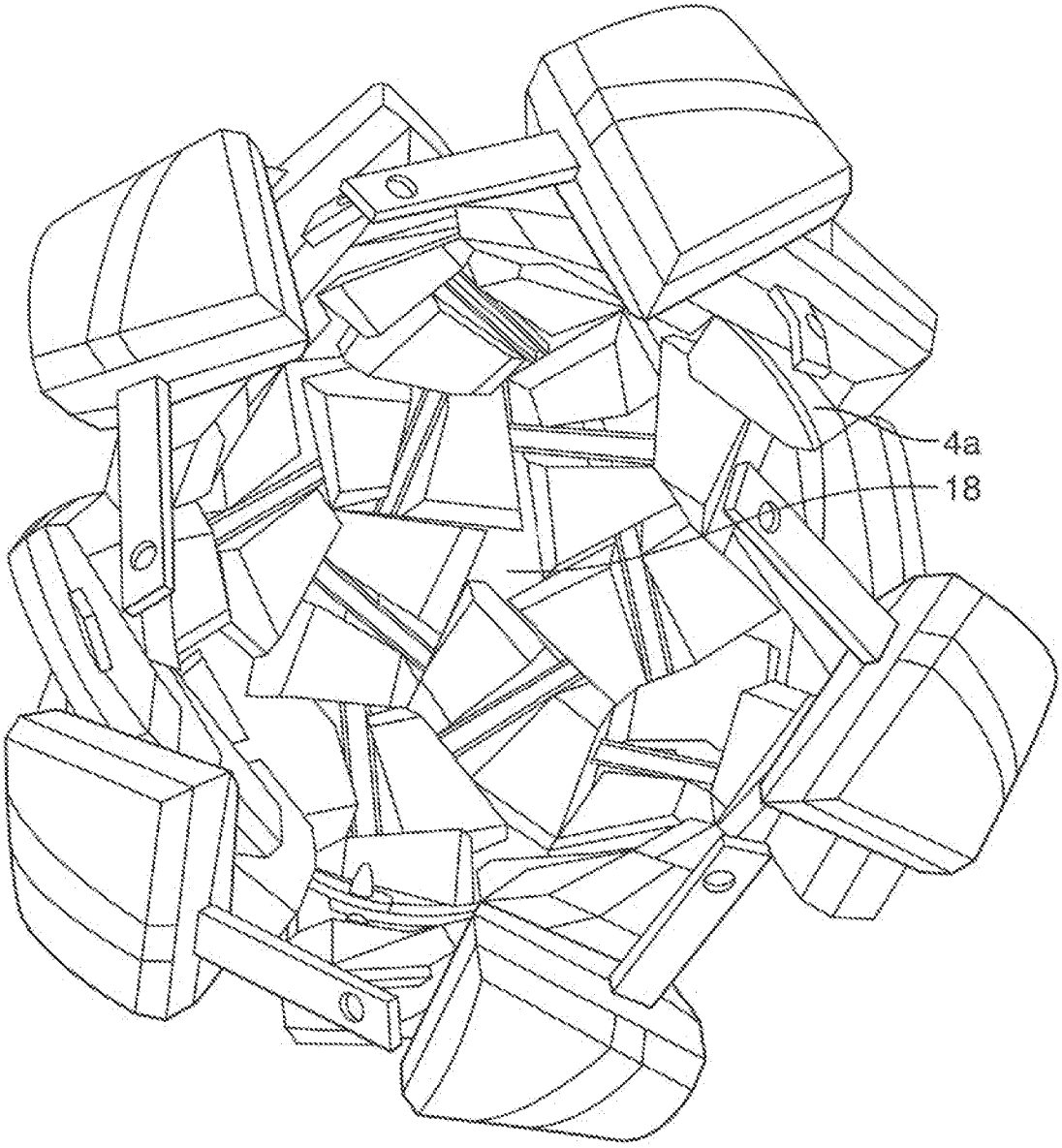
FIG. 8 shows a further stage in the ball weaving process of six of the subassemblies of FIGS. 1A and 1B to form a takraw ball.
Figure 9:
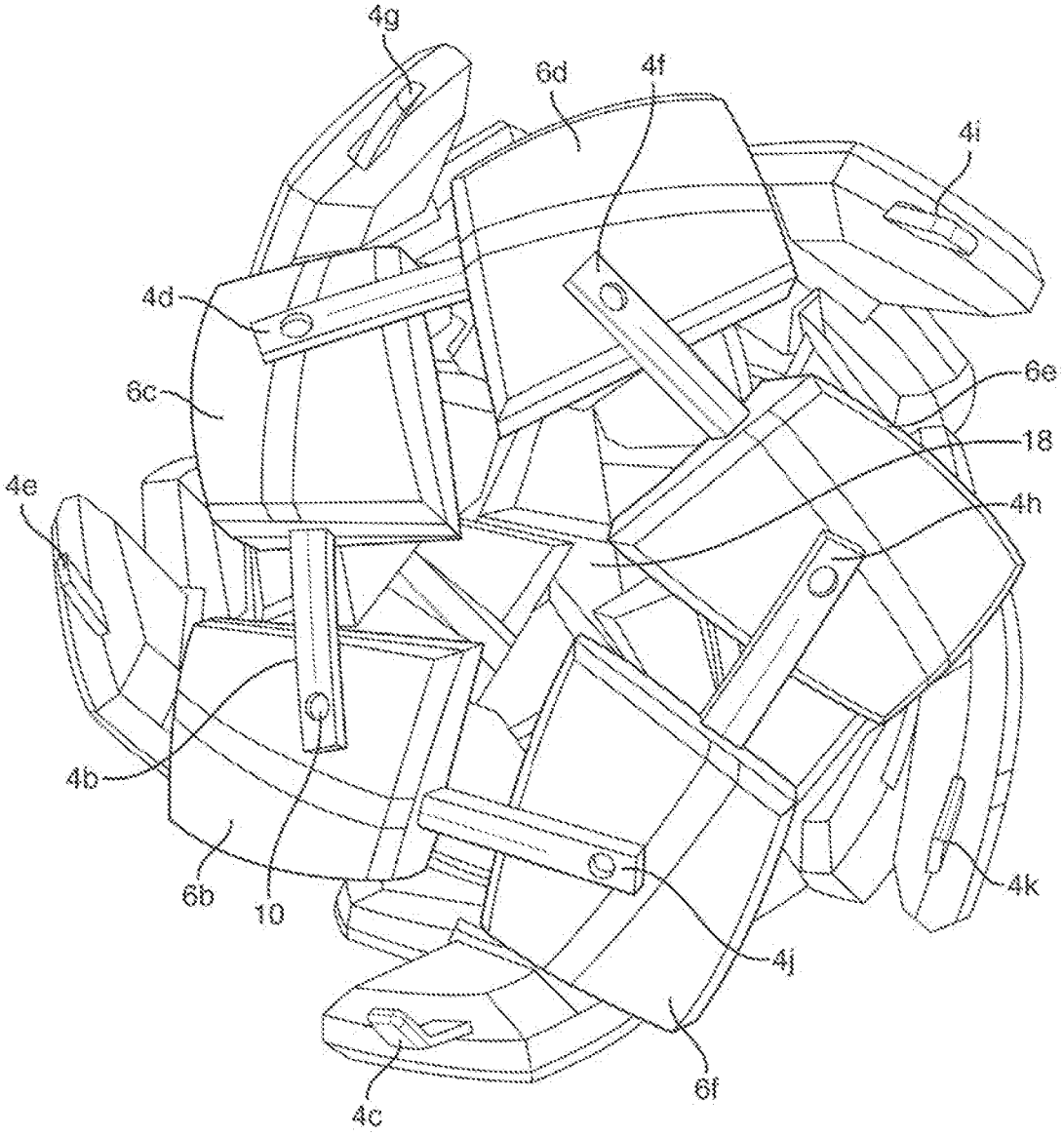
FIG. 9 shows yet a further stage in the ball weaving process of six of the subassemblies of FIGS. 1A and 1B to form a takraw ball.
Figure 10:
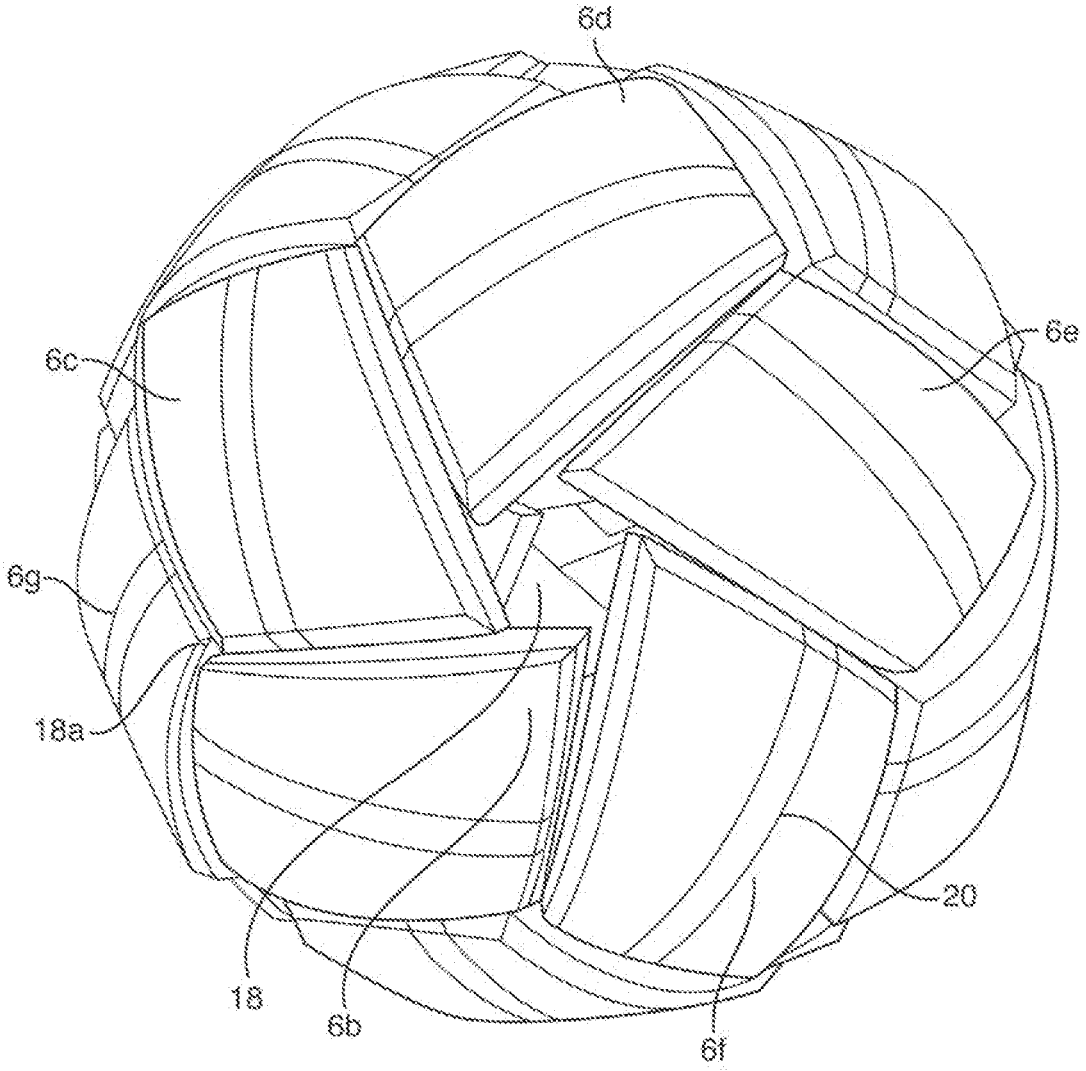
FIG. 10 shows the finished takraw ball after the weaving process of FIGS. 6 to 9 is complete.

FIG. 6 shows a first stage in the weaving of strip subassemblies 2 to form a takraw ball. Five of the six strip subassemblies 2 are laid on top of each other to create a pentagon-shaped gap 18 surrounded by pads 6*a*, which correspondingly create a star shape. Each strip subassembly 2 is laid respectively over and under the two strip subassemblies 2 immediately adjacent it, creating ten loose ends radially arranged. As shown in FIG. 7, the sixth strip subassembly 2 is bent and its ends are fastened together, for example with a plastic press-in fastener 12 in the through holes 10 at either end of the backbone strut 4*a*, to form a hoop. FIGS. 8 and 9 show further stages in the ball weaving process of six strip subassemblies 2 to form a takraw ball. Five of the ten loose ends of the five strip subassemblies 2, always those ends where the strip subassembly is underneath an adjacent strip subassembly, are bent into the middle above the pentagon-shaped gap 18 and the sixth hoop is placed over them and clicked into place, the pads 6 determining the exact position in which it sits (FIG. 8). The now shorter ten loose ends are fitted together to make another star shape at the opposite side of the ball to the first one (FIG. 9). Each strip subassembly 2 has its ends fastened together, for example by a plastic press-in fastener 12 in the through holes 10 at either end of the backbone strut(s) 4, to create six whole hoops interwoven into a sphere, making up the completed takraw ball as shown in FIG. 10. Referring back to FIG. 9, strut end 4*b* is tucked beneath pad 6*b* and is fastened to the opposite end 4*c* of the same backbone strut; strut end 4*d* is tucked beneath pad 6*c* and is fastened to opposite end 4*e* of the same backbone strut; strut end 4*f* is tucked beneath pad 6*d* and is fastened to the opposite end 4*g* of the same backbone strut; strut end 4*h* is tucked beneath pad 6*e* and is fastened to the opposite end 4*i* of the same backbone strut; and strut end 4*j* is tucked beneath pad 6*f* and is fastened to the opposite end 4*k* of the same backbone strut. The outside of the pads 6 may be profiled, contoured, textured or roughened as desired to give any surface texture or pattern, such as for example surface striations 20 to mimic the appearance of natural rattan fibres. Different pads or different parts of pads may be differently coloured to produce different coloured surface patterns in the finished ball.

The plan shapes of the pads 6 threaded onto the backbone struts 4 may be any suitable shape tessellating to form the outer surface of the ball, or partly tessellating to provide a ball surface which has holes or gaps in it. For example, the plan shapes of the pads 6 may be parallelograms, each parallelogram having a major internal angle of 120° on one pair of opposing vertices and a minor internal angle of 60° on the other pair of opposing vertices. Each parallelogram may have a long and a short side and the five pads 6 on each backbone strut 4 may be spaced apart by the transverse width of a parallelogram, such that when two subassemblies 2 are crossed over each other, the pad 6 of one subassembly 2 fits in between two of the pads 6 of the other subassembly 2 in a perpendicular orientation. At each point 18*a* (FIG. 10) where three pads 6*b*, 6*c*, 6*g* meet, they meet at the major internal angle, the long edge of the first pad 6*b* contacting the short edge of the second pad 6*c*, the long edge of the second pad 6*c* contacting the short edge of the third pad 6*g* and the long edge of the third pad 6*g* contacting the short edge of the first pad 6*b*. There are twenty such meeting points, corresponding to the twenty weaving crossover points in a traditionally woven rattan takraw ball. The minor internal angles of five pads 6*b*, 6*c*, 6*d*, 6*e*, 6*f* meanwhile, almost meet such as to form a star shape with a central gap, which may be a pentagon-shaped gap 18. If six subassemblies 2 are being used, this occurs at twelve points on the ball, creating twelve pentagon-shaped gaps 18. Alternatively, the "long" and "short" edges of the parallelogram-shaped pads may be made of equal length, so that the pentagon-shaped gaps 18 become meeting points. Thus, rather than having twenty meeting points 18*a* and twelve gaps 18, the ball may be substantially completely closed, with thirty-two meeting points and no gaps. At twenty of those points the major internal angles of three adjacent parallelogram-shaped pads 6 meet. At the other twelve of those points the minor internal angles of five adjacent parallelogram-shaped pads 6 meet.

Figure 11:
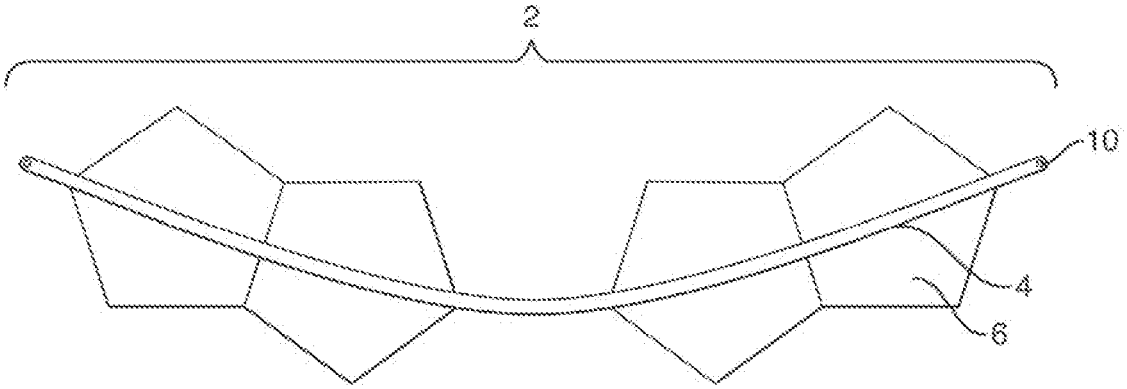
FIG. 11 is a bottom (inside surface) plan view of an alternative embodiment of a strip subassembly to FIGS. 1A to 10, comprising a backbone strut and four pentagon-shaped pads which may be used together with identical subassemblies to weave a ball embodying the invention; and, FIG. 12 shows the finished ball woven from three of the strip subassemblies of FIG. 11.
Figure 12:
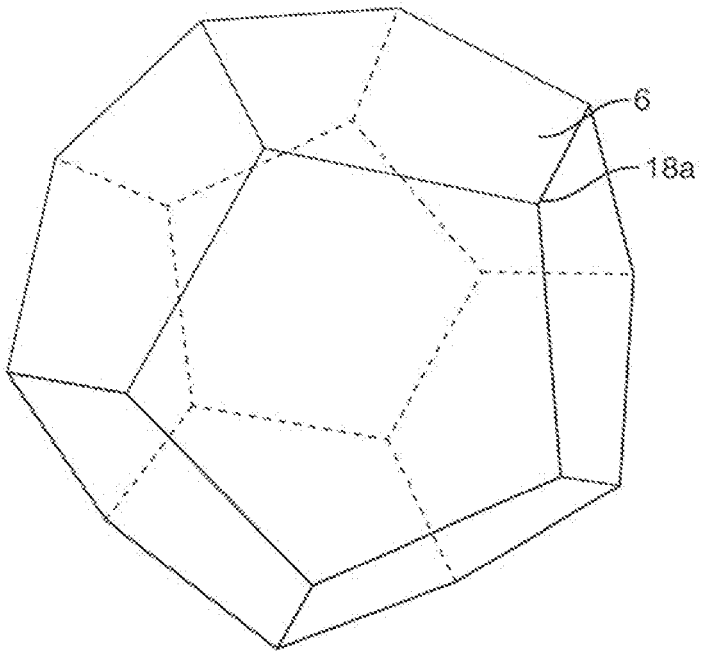

Other fully or partly tessellating pad shapes are also possible, as are other numbers of pads 6 per strip subassembly 2 and other numbers of strip subassemblies 2 per ball. FIG. 11, for example, shows an alternative embodiment of a strip subassembly 2 comprising a backbone strut 4 and four pentagon-shaped pads 6. Three of these strip subassemblies 2 may be woven together to produce a dodecahedron-shaped ball, as shown in FIG. 12, with twelve faces, thirty edges and twenty vertices, each vertex being the meeting point 18*a* of three of the pentagon-shaped pads 6. Other non-limiting examples of possible shapes for balls woven from strip subassemblies 2 according to the disclosure include a tetradecahedron (14 sides), an icosahedron (20 sides), a rhombicuboctahedron (26 sides), an icosidodecahedron (32 sides) and a rhombicosidodecahedron (62 sides). Any holes or gaps in the surface of the ball produced by partly tessellating pads 6 may have any desired shape. For example, referring to FIG. 10, the parts of the pads 6 bounding the gap 18 may be given an arcuate shape, centred on the centre of the gap 18, so that the gap 18 produced by the partly tessellating pads 6 is circular. Rather than being straight, the edges of neighbouring interlocking pads may be provided with complementary interlocking recesses and protrusions.

The ball structures and constructions described above provide functions including:

A. Reduction of pain for a player. The side strips described in any of documents GB2196861, WO95/28206 and GB2494478 are relatively rigid, especially in the exposed peak regions, such that, when a ball hits any part of a player's body, the contact area is likely to be a concentrated point with consequent high loading. The problem is exacerbated by the relatively sharp edges and corners produced where one strip overlaps another. There is also a problem of relative movement of the strips as the ball deforms, pinching the player's skin or hair as the ball springs back to its original shape. The slivers in GB2513862 deflect transversely away from one another under load to spread out the contact area, transmitting a lighter force per area to the player. In the present invention, there are no interwoven side strips to hold the backbone struts rigid, so these deform more on impact than the side and centre strips of previous synthetic takraw balls. The pads themselves also deform on impact due to the properties of the material from which they are made, transmitting an even lighter force per area to a person striking or struck by the ball. There is no overlapping of pads, with consequent reduction or elimination of the prior art protruding edges and corners and the nipping or pinching phenomenon. This enables takraw or other sports and games to be played barefoot without considerable discomfort to the players and particularly promotes amateur involvement in the game.

B. Lower density material can be used to make the pads when desired, so the entire ball may weigh less than previous models, further reducing the pain for the player upon impact, as well as making the ball easier to throw and catch, particularly benefitting newer players. On the other hand, the weights of the ball components can be designed and adjusted to achieve any desired ball weight or range of ball weights, including those specified for regulation takraw balls.

C. Ease of manufacture. The lack of side strips significantly reduces the amount of time and effort that goes into assembling the ball, since it reduces the weaving steps and makes the remaining weaving steps easier, as well as potentially reducing the number of fasteners from eighteen to six, in the case of a regulation takraw ball. The potential for scratching, abrading or otherwise damaging the ball's exposed surface during its assembly is reduced or eliminated.

D. Reduced use of plastic. The same size of ball is achieved with less plastic since there is no overlap of the pads as there is of the side strips of the previous models.

E. Greater durability. The pads of the present invention deform on impact, reducing the likelihood of abrasion of the surface of the ball. The backbone struts are also unlikely to splinter since they are protected by the pads. The pads may be provided with a tougher surface layer if desired.

F. More even stiffness and deformation in play over the whole ball. There is less overlapping of pieces (overlapping being a feature which gives variation of stiffness), so there is a more even stiffness over the entire ball. It is also under less internal stress than the models with overlapping side strips, due to the relative lack of overlapping pieces. Less overlap means lower stress at the point where three pads meet, compared with the equivalent point on the earlier models, the point where three plastic hoops cross. The stress at the point is spread across the entire edge of each of the three pads, whilst in the earlier models it is concentrated at the point of intersection of the hoops. Less concentrated stress at any one point means that the ball is less likely to come apart during play. No overlaps means no nipping or pinching of the player's skin or hair as the ball deforms and then resiliently recovers, and no raised or sharp edges or corners to concentrate impact stresses; all of which makes the ball more comfortable to play with.

G. Improved control of frictional damping and sound of the ball in play. Unlike the side and centre strips of previous models, the pads do not overlie one another. This permits greater ball flexibility and greater design freedom in controlling frictional damping within the ball structure, and hence greater design freedom in controlling the bounce characteristics, sound and feel of the ball in play.

What is claimed is:

1. A strip subassembly for weaving together with other such strip subassemblies for forming a ball, the strip subassembly comprising:

a resilient, elongate backbone strut having ends which are configured for fastening together so as to form the strip subassembly into a hoop; and a plurality of cushioning pads attached to the backbone strut and spaced apart along the length of the backbone strut;

wherein the cushioning pads are configured so that when a plurality of such strip subassemblies are woven together to form the ball, the cushioning pads will interlock to form the outer surface of the ball and the backbone struts will form an internal structure of the ball which is not exposed at the outer surface of the ball; and wherein each cushioning pad comprises a unitary body of cushioning material having:

(a) a hole or passage running through the unitary body longitudinally and through which the backbone strut passes; and (b) a channel running within and across the unitary body transversely whereby the backbone strut of another such strip subassembly forming the ball is receivable in the channel.

2. The strip subassembly claim 1, wherein channel intersects the longitudinal hole or passage whereby the backbone strut of the another such strip subassembly forming the ball is receivable in the channel so as to directly contact the backbone strut passing through the hole or passage.

3. The strip subassembly of claim 2, wherein the passage and the channel are positioned and configured so that when two or more such subassemblies are woven together to form the ball, outer surfaces or edges of their cushioning pads are aligned along a spherical or regular polygonal surface.

4. The strip subassembly of claim 1, wherein the backbone strut comprises a non-linear shape.

5. The strip subassembly of claim 1, wherein the backbone strut comprises a roughened or textured surface or surface portion(s).

6. The strip subassembly of claim 1, wherein each cushioning pad is secured to more than one backbone strut in parallel.

7. The strip subassembly of claim 1, wherein the cushioning pads are glued onto the backbone strut(s), co-moulded with the backbone struts, or are insert moulded onto the backbone struts.

8. The strip subassembly of claim 1, wherein the cushioning pads are parallelogram shaped.

9. The strip subassembly of claim 1, wherein the cushioning pads are spaced apart on the backbone strut by a transverse width of the cushioning pad, such that when two such strip subassemblies cross each other the cushioning pad of one strip subassembly abuts two of the cushioning pads on the other strip subassembly.

10. The strip subassembly of claim 1, wherein there are exactly five cushioning pads attached to the backbone strut.

11. A ball assembled from strip subassemblies as claimed in claim 1, by weaving a plurality of the strip subassemblies together.

12. The ball of claim 11, wherein edges of adjacent cushioning pads on different backbone struts closely abut one another over at least a part of their length.

13. The ball of claim 12, wherein the cushioning pads are parallelogram shaped and three of the cushioning pads meet at a point at the major internal angles of the parallelogram shapes; and/or wherein the minor internal angles of five cushioning pads lie adjacent to one another at a pentagon-shaped gap in the ball or meet at a point.

14. The ball of claim 11, wherein the ball is a takraw ball.

15. The ball of claim 13, in which the cushioning pads do not overlap.

16. The ball of claim 15, wherein the ball is assembled from exactly six of the strip subassemblies.

* * * * *